US007218057B1

(12) United States Patent
Sansone et al.

(10) Patent No.: US 7,218,057 B1
(45) Date of Patent: May 15, 2007

(54) PAPI 1 STYLE B COMBINATION LAMP BYPASS AND TILT SWITCH AND CONTROL SYSTEM

(75) Inventors: John M. Sansone, Oak Lawn, IL (US); Kenneth R. Horning, Addison, IL (US)

(73) Assignee: Multi Electric Mfg. Inc., Chicago, IL (US)

( * ) Notice: Subject to any disclaimer, the term of this patent is extended or adjusted under 35 U.S.C. 154(b) by 293 days.

(21) Appl. No.: 11/067,183

(22) Filed: Feb. 26, 2005

(51) Int. Cl.
*H05B 37/00* (2006.01)

(52) U.S. Cl. ..... 315/132; 315/133; 315/136

(58) Field of Classification Search ..... 315/129, 315/130, 131, 132, 133, 136
See application file for complete search history.

(56) References Cited

U.S. PATENT DOCUMENTS 3,735,339 A * 5/1973 Knudson ..... 340/953

4,396,868 A * 8/1983 Watanabe et al. ..... 315/130

* cited by examiner

*Primary Examiner*—David Vu
(74) *Attorney, Agent, or Firm*—Nicholas A Camasto

(57) ABSTRACT

A Style B PAPI system comprises a plurality of identical lamp housing assemblies, each with one or more lamps and each housing assembly including: an electronic bypass circuit with first and second oppositely poled SCRs coupled across the terminals of each lamp; a zener diode; and a diode bridge for developing a first trigger voltage across the zener diode in the event of failure of a lamp. The first trigger voltage causes alternate conduction in the first and second SCRs from the AC voltage developed across the failed lamp. A lamp control circuit includes a third SCR that is coupled across the zener diode for developing a second trigger voltage for similarly driving the SCRs. The lamp control circuit is operated by a microcontroller-controlled common lamp control circuit that activates all of the lamp control circuits and disable all of the lamps in response to a tilt condition for the lamp housing assembly. All of the microcontrollers monitor a series-connected control loop that interconnects the lamp housing assemblies for activating all of the electronic bypass circuits in the event of a tilt condition occurring at any of the lamp housing assemblies.

22 Claims, 2 Drawing Sheets

10
12
14
16
18
HA
HA
HA
OUT
IN
C
P
34
36
38
40
42
CONSTANT CURRENT SOURCE
LINE
GROUND LEVEL
CONDUIT/CABLING
26
24
22
20
BYPASS
BYPASS
BYPASS
28
30
32
COMMON LAMP CONTROL
48
μC
46
TILT DETECTOR LOCAL
58
TILT SW.
64
TILT DRIVE LOCAL
70
TILT DRIVE REMOTE
90
TILT DETECTOR REMOTE
80
POW. SUPP.
Y
X
CONTROL LOOP OUT
37

AC IN
BYPASS
BYPASS
V1
V2
TEST

PAPI 1 STYLE B COMBINATION LAMP BYPASS AND TILT SWITCH AND CONTROL SYSTEM

BACKGROUND OF THE INVENTION AND PRIOR ART

The present invention relates generally to Precision Approach Path Indicator (PAPI) visual guidance systems for aiding pilots in landing an aircraft. Specifically, the PAPI system defines the vertical approach angle to the runway and indicates to the pilot, via colored lights, whether the angle of approach of the aircraft to the runway is correct. The colored lights are produced in a number of Lamp Housing Assemblies (LHAs), as will be described below. The Federal Aviation Administration (FAA) establishes the standards for PAPI systems in the United States, whereas the standards for foreign PAPI systems may differ. It should be understood that, while the present invention is described with respect to the FAA endorsed systems, its application isn't limited to FAA endorsed systems.

The components in an FAA Style B PAPI system are powered by the well-known and widely used constant alternating current (AC) loop used in most of the world's airport lighting systems, whereas the components in an FAA Style A PAPI system are powered in parallel directly from utility line power. In any PAPI system their are a number of important considerations, among them being: power consumption; number and type of lamps; size of the LHA; system reliability; ease of installation and service; safety with respect to exposed wiring and high voltages; ease of detection and identification of lamp or housing problems; environmental impact of components used; and minimization of the number of wires and interconnections.

The PAPI system generally comprises an array of two or four Lamp Housing Assemblies (LHAs), each of which may contain two or three individual lamps. The LHAs are located adjacent the side of, and perpendicular to, a runway and precisely aimed to define a correct vertical approach angle for guiding an incoming aircraft. Each LHA is usually fitted with an optical filter to present a white light when the aircraft is too high, i.e., above the correct approach angle, and a red light when the aircraft is too low or below the correct approach angle. When the aircraft is too high, all of the LHAs will be seen as white lights, when the aircraft is too low, all of the LHAs will be seen as red lights and when the aircraft is within the correct approach angle, one-half of the LHAs in the array will present a white light and one-half will present a red light. Generally the PAPI system comprises either two LHAs or four LHAs, with each LHA having either a set of two lamps or a set of three lamps. The two or three lamp sets appear as a single light when viewed at a far distance. A two LHA system will therefore show: two sets of red lights when the aircraft is too low; one set of white lights and one set of red lights for a correct approach; and two sets of white lights when the aircraft is too high. A four LHA system will also indicate intermediate positions within the correct approach angle. Thus the light indications will be: four sets of red for too low; one set of white and three sets of red for slightly low; two sets of white and two sets of red for correct approach angle; three sets of white and one set of red for slightly high; and four sets of white for too high. Each LHA also includes a tilt detection system and tilt switch control circuitry for disabling the entire LHA array should the physical attitude or positioning of any of the LHAs be disturbed a predetermined amount. This is necessary since the color of the light seen by the pilot could be erroneous and create a potentially hazardous situation should the LHA position be disturbed sufficiently to change its aiming. The choice of PAPI system selected is determined by a number of factors, such as airport size, aircraft size and location, traffic density, economics and the like. For example, some airport installations use multiple PAPI systems located at differing distances (touch down points) along the runway to accommodate aircraft having different landing requirements. The present invention is useful in all PAPI Style B systems.

The current state-of-the-art FAA Style B PAPIs include one or more series isolation transformers for the lamps in each LHA and a separate transformer at a designated master LHA to power tilt switch circuitry. A master LHA also contains the control and timing circuits for the tilt system, which includes a tilt status monitoring loop and a tilt control loop. Each LHA has a tilt switch and some mechanism to cause the master LHA to disable the entire LHA array should a tilt condition occur in any of the LHAs. In practice a tilt status signal from each LHA is sent to the master LHA which, in turn, directs each of the LHAs in the array to disable its light output, via a shorting device such as a relay, should a tilt condition occur at any of the LHAs. In order to maintain the constant current series circuit, it is also common practice to have either; (a) one isolation transformer per lamp in each LHA or; (b) a single transformer and a lamp bypass circuit for each lamp in the LHA. Therefore, with each LHA having either two or three lamps, two or three isolation transformers are required, or one isolation transformer and two or three lamp bypass circuits are required. Such systems are relatively costly and consume a substantial amount of electrical power.

The LHA is mounted above ground adjacent to the runway and connected to a small container, colloquially referred to as a "handhole" that is buried behind the LHA. Each container includes a current transformer and is connected to a main constant current source and to the other hand-holes via an underground conduit or directly buried cabling. It will be appreciated that a minimum number of wires and connection points in the PAPI system is a desirable objective with respect to cost, installation and maintenance. Also, it is desirable to minimize the amount of above-ground equipment to avoid damage to or from vehicles and aircraft. In general, the handholes and LHAs are interconnected through break-away type connectors that are designed to readily separate in the event of contact with a moving vehicle. The connectors are also arranged to minimize exposure of high voltages in the event of separation. In these aspects, the invention will be seen to provide major improvements.

Multi Electric Mfg., Inc., the assignee of the present invention, has developed and received FAA approval for a PAPI Style B system utilizing three 105 watt pre-focused lamps per LHA as opposed to the previous standard of two or three 200 watt lamps. The system includes bypass circuitry to permit continued LHA operation with one or more lamp failures. The total power consumption for each LHA is reduced from 400/600 watts to 315 watts. The current system uses standard tilt switches including pendulum types where contact is made via a ball of mercury. These mercury vial switches are not only environmentally objectionable, they are becoming more difficult to obtain. In Multi's view, an optical pendulum switch is preferred except that it also requires a power connection for a light-emitting diode (LED) and a signal connection for a photo transistor detector, which undesirably adds to power consumption and the number of interconnections. In the Multi system, the lamps are powered through a single isolation transformer requiring two wires entering the LHA. A single 300 watt transformer of minimum 90% efficiency is used, as opposed to the three-100 watt transformers of minimum 85% efficiency in the prior art.

The present invention utilizes the above-described FAA approved Multi Electric PAPI Style B system, with the power for a microcontroller controlled bypass system and an opto-coupler pendulum tilt system being developed from a small power supply energized by the series constant current loop in each LHA. The small power supply in each LHA may be of standard design and still produce an energy savings over the 30 watt transformer used in the master LHA of the prior art for the control circuitry. However, also disclosed herein is a novel power supply that requires only a 2 watt transformer in each LHA.

In prior art systems, the interconnect wiring for the power leads and tilt switch control circuits could have as many as ten connections at the master LHA and eight connections at each of the other (slave) LHAs. In contrast, in the inventive system all of the LHAs are identical, each having only four connections—two power connections and two control connections. There is no master LHA. Further in the inventive system each LHA includes a microcontroller, the power for which (as well as that required to operate the bypass circuits and opto-coupler tilt system) is derived from the constant current lamp circuit. In this context, the term microcontroller connotes an internal memory, as opposed to the usual microprocessor that uses an external memory. The arrangement reduces system cost and complexity and enhances its manufacture, installation and service.

SUMMARY OF THE INVENTION

The present invention energy efficient PAPI Style B system is characterized by a number of novel aspects, among them being: a microcontroller combination tilt and electronic bypass system that is powered from the series constant current circuit for the lamps; a readily installed optical pendulum tilt switch arrangement of improved accuracy; identical LHAs without a master LHA; and a reduced number of above-ground components with a minimal number of interconnections.

OBJECTS OF THE INVENTION

A principal object of the invention is to provide a novel PAPI Style B system.

Another object of the invention is to provide a PAPI Style B system of lower cost and higher efficiency than the prior art.

A feature of the invention is the provision of a combination tilt and bypass arrangement in a PAPI Style B system.

Another feature of the invention resides in the use of microcontrollers in a control loop for tilt control in a PAPI Style B system.

A further feature of the invention resides in the use of a readily installed optical tilt switch arrangement of greater accuracy.

BRIEF DESCRIPTION OF THE DRAWINGS

These and other objects features and advantages of the invention will be apparent upon reading the following description in conjunction with the drawings in which.

DESCRIPTION OF THE PREFERRED EMBODIMENT

Figure 1:
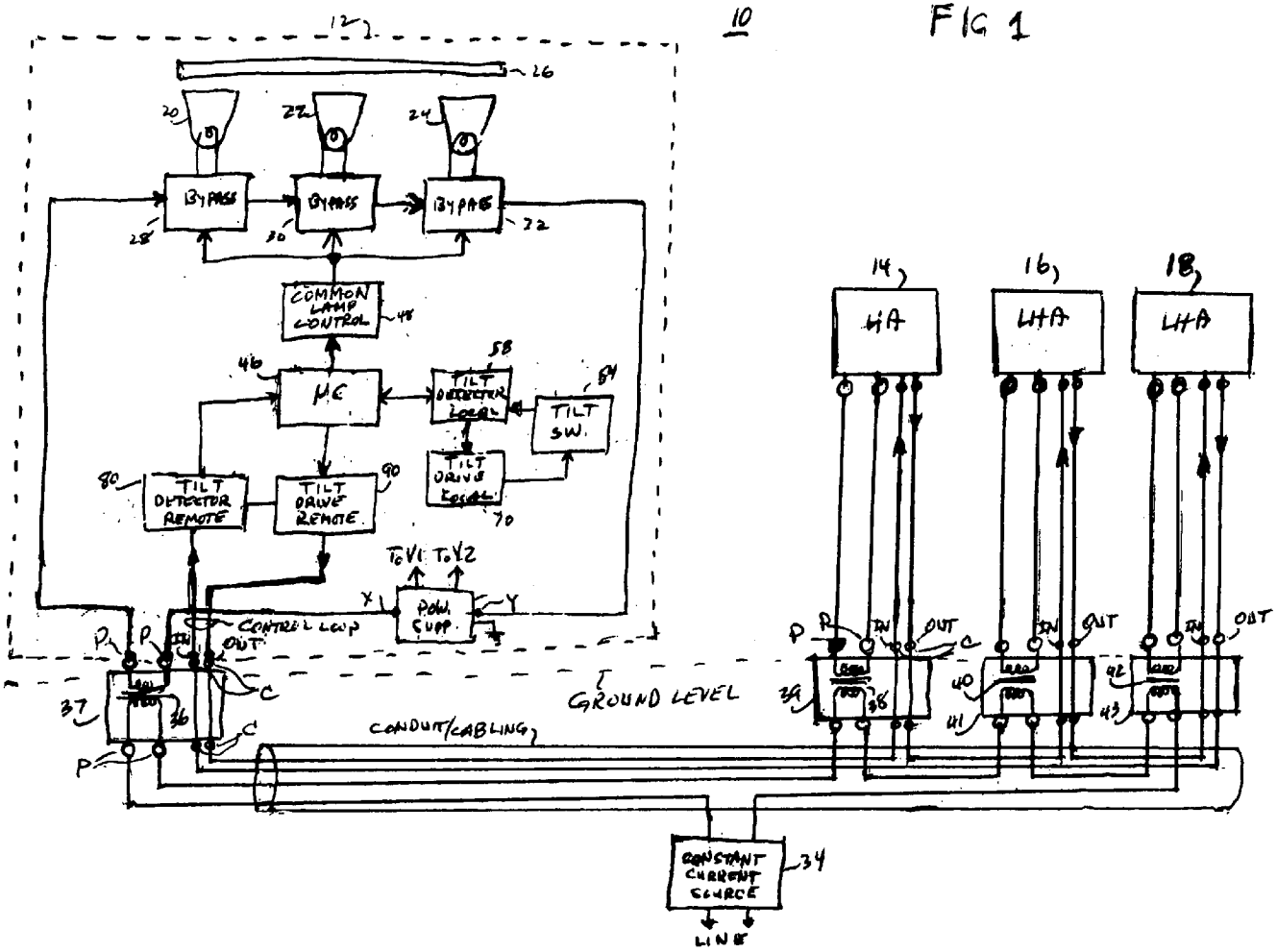
FIG. 1 is a block diagram of a PAPI Style B system incorporating the invention.

Referring to FIG. 1, a PAPI Style B system, constructed in accordance with the invention, includes four LHAs 12, 14, 16 and 18, with only the components in LHA 12 (within a dashed line block) being generally disclosed. It will be understood that all of the LHAs 12–18 are identical and that the discussion of LHA 12 is applicable to the other LHAs 14, 16 and 18. LHA 12 includes three lamps 20, 22 and 24 and a suitable lens (or lenses) 26 for displaying either a white light or a red light, depending upon the vertical viewing angle, to an approaching aircraft, as discussed above. In practice, a split beam lens is used, i.e., the lower half of the lens is colored red while the upper half is clear, thus producing a vertical discrimination in the perceived light beam color. Each of the lamps 20, 22 and 24 is coupled to a respective one of electronic bypass circuits 28, 30 and 32 that, in addition to being individually activated in the event of a lamp failure, are jointly controllable by a common lamp control circuit 48. The LHAs are powered via two power terminals, labeled P, from a constant current source 34 that supplies the series-connected primary windings of a plurality of current isolation transformers 36, 38, 40 and 42, each of which is individually located in a corresponding one of handholes 37, 39, 41, and 43. As discussed the handholes are buried adjacent the runway and have four power terminals (P) and four control loop terminals (C) extending above ground, whereat connections are made via break-away connectors. The actual terminals and connectors employed throughout are not part of the invention and are therefore not illustrated in detail.

The secondary winding of isolation transformer 36 is part of another constant current series circuit that includes the three lamps 20, 22 and 24 (and their respective electronic bypass circuits 28, 30 and 32) and a DC power supply 44 that provides power to the tilt and bypass circuits. A microcontroller 46 establishes timing for monitoring and control of a common lamp control circuit 48, a local tilt detector circuit 58, and a remote tilt drive circuit 90. The remote tilt drive circuit 90 and a remote tilt detector circuit 80 are connected in a control loop via the C terminals labeled OUT and IN on handhole 37. The control loop comprises a series circuit among all of the LHAs, as will be discussed in connection with FIG. 2.

Figure 2:
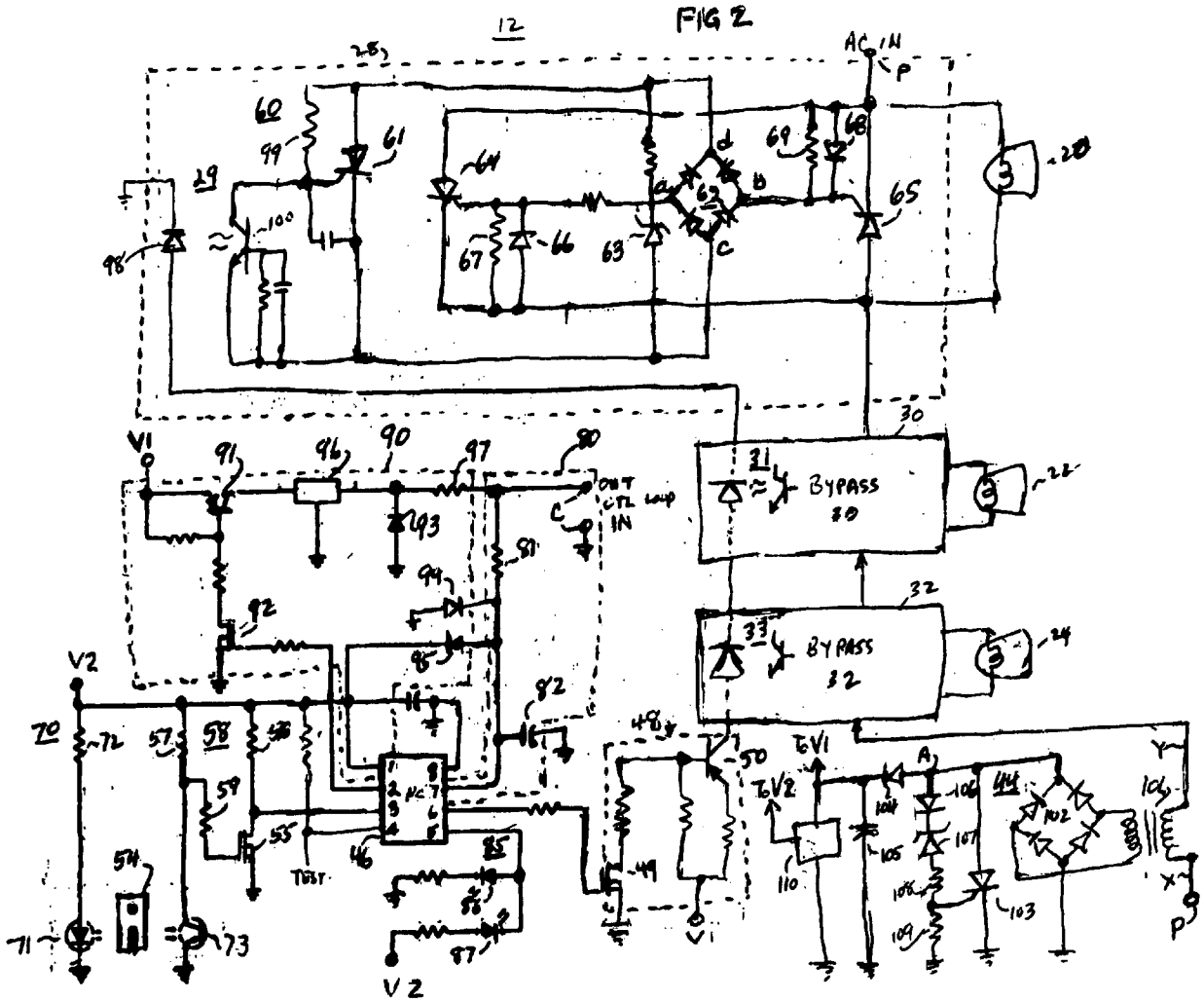
FIG. 2 is a circuit diagram of portions of FIG. 1.

FIG. 2 illustrates details of LHA 12, it being understood that the other LHAs 14, 16 and 18 are identical. Similarly, only bypass circuit 28 is shown in detail, the other bypass circuits 30 and 32, being the same. As indicated by the dashed line box, common lamp control circuit 48 includes a field-effect transistor (FET) 49 and a transistor 50. The common lamp control circuit 48 is coupled to pin 6 of microcontroller 46 and controlled by the logic voltage thereon. The collector-emitter output of transistor 50 is connected in series with the bypass circuits, specifically with three opto-couplers 29, 31 and 33 in bypass circuits 28, 30 and 32, respectively. Transistor 50 and the three resistors connected to it form a constant current source for opto-couplers 29, 31 and 33. Lamp 20, which is connected in the constant current series circuit with lamps 22 and 24 and power supply 44, has oppositely poled SCRs 64 and 65 connected across its terminals. The gate of SCR 64 is connected to a corner "a" of a diode bridge 62 and to a bias arrangement of a diode 66 and a resistor 67, whereas the gate of SCR 65 is connected to an opposite corner "b" of diode bridge 62 and to a bias arrangement of a diode 68 and a resistor 69. A zener diode 63 and a series resistor are connected across the other opposite corners "c" and "d" of diode bridge 62 and across the output of an SCR 61 of a lamp control circuit 60 that is activated by opto-coupler 29.

Power Supply Discussion

As mentioned above, power supply 44 is a novel arrangement that enables very high efficiency. A conventional power supply comprises a voltage driven transformer followed by a half-wave or full-wave rectifier connected to a filter capacitor and load (and often a voltage regulator). The transformer delivers current in periodic, discontinuous parcels at the peaks of the AC line power sinusoid for replenishing the charge stored in the filter capacitor (and discharged by the load and regulator, if any). Thus the transformer delivers little to no current during a significant portion of the AC line cycle. The preferred power supply 44 used with the PAPI Style B system is the dual of such conventional power supply. In it a current transformer 101 delivers discontinuous parcels of current, as in a conventional power supply. However, during non conductive portions of the AC current waveform, current transformer 101 is connected to a low impedance or short circuit rather than to a high impedance. This low impedance results in low power losses being reflected back to the current circuit that is coupled to the current transformer 101. The primary winding of transformer 101 is connected to the X and Y terminals in the constant current lighting loop (FIG. 1). The secondary winding of transformer 101 supplies a full-wave bridge rectifier 102, the anode of which is connected to a node A that comprises the junction of the anodes of diodes 104 and 106 and the anode of an SCR 103. The cathode of diode 104 is connected to a filter capacitor 105, where the voltage V1 is produced, and to the input of a voltage regulator 110. The output of voltage regulator 110 provides a 5 volt power supply V2 for use by the microcontroller 46 and the components connected thereto. The cathode of diode 106 is connected to the cathode of a zener 107 that is returned to ground through the series connection of resistors 108 and 109. The junction of resistors 108 and 109 is connected to the gate of SCR 103, the cathode of which is connected to ground.

In operation of power supply 44, DC charging current is supplied to capacitor 105 from diode bridge 102 each half-cycle of the AC input wave. When the instantaneous voltage at V1 across capacitor 105 reaches approximately 15 volts, diode 106 conducts, zener 107 goes into avalanche and the current to the gate of SCR 103 triggers it into conduction and reduces the voltage at node A to approximately zero volts. Diode 104 is therefore reverse biased and a low impedance is coupled to the secondary winding of transformer 101 (and hence reflected to the primary of the transformer) via bridge rectifier 102 and conducting SCR 103. The low impedance at the secondary of the transformer results in a low voltage burden to the primary of the transformer and reduces the voltage drop in the constant current lighting loop. SCR 103 remains in conduction until the end of the half cycle of the constant current lighting loop when the polarity of the current reverses. At the beginning of the next power half-cycle, transformer 101 again provides current to recharge capacitor 105 for a period of time until the voltage across capacitor 105 again reaches about 15 volts, at which time zener 107 conducts and the cycle repeats. Thus, transformer 101 provides an average current for the 15 volt power supply V1 for a small interval of time during the constant current lighting loop cycle and a nearly short circuit during the remainder of the power cycle.

Lamp Failure System Discussion

The constant current series circuit preferably operates at 6.6 amperes. At this current level, the resultant voltage developed across 105 watt lamp 20 is about 16 volts. Under normal operating conditions with lamp 20 conducting, zener diode 63 is not in avalanche. When the upper terminal of lamp 20 is positive, current flow is as follows: through diode 68 to corner "b" of diode bridge 62; from corner "d" of diode bridge 62 to the cathode of zener diode 63; from the anode of zener diode 63 to corner "c" of diode bridge 62; from corner "a" of diode bridge 62 through resistor 67 to the lower terminal of lamp 20. When the lower terminal of lamp 20 is positive, current flow is as follows: through diode 66 to corner "a" of diode bridge 62; from corner "d" of diode bridge 62 to the cathode of zener diode 63; from the anode of zener diode 63 to corner "c" of diode bridge 62; from corner "b" if diode bridge 62 through resistor 69 to the upper terminal of lamp 20. As mentioned, the approximately 16 volt potential developed across corners "c" and "d" of diode bridge 62 is not sufficient to drive zener diode 63 into avalanche. Therefore the voltages across corners "a" and "b" of diode bridge 62 (the voltages supplied to the SCR gates) are insufficient to initiate conduction in SCRs 64 and 65.

By the very nature of a constant current source, its load voltage is proportional to load resistance or impedance. Therefore, should lamp 20 fail, the voltage across its terminals increases substantially (to about 47 volts) causing zener diode 63 to avalanche and apply a first-trigger voltage to the gates of SCRs 64 and 65 causing them to alternately conduct as the polarity of the AC input voltage changes. When SCR 64 or 65 conducts the voltage appearing across the terminals of lamp 20 is reduced substantially effectively shorting out the lamp whenever zener diode 63 is in avalanche. Should another lamp in the LHA experience a failure, a similar sequence of events will cause its associated zener diode to avalanche and apply the first-trigger voltage to its associated SCRs, driving them into alternating conduction to effectively bypass its terminals.

It will be noted that should a lamp failure be intermittent or a lamp experience a temporary fault condition, normal lamp operation will resume when the abnormal condition is removed since the increase in voltage across the lamp will not occur to drive the zener diode into avalanche. The time for the system to return to normal is dependent upon the time constant of the bias networks coupled to the SCR gates. The operation of the bypass circuitry is thus seen to be automatic, which translates into a significant benefit in system reliability. More importantly, however, the operation of the bypass circuitry is necessary in order to maintain continuity within a series-connected constant current circuit in the event of the failure of a load in the current circuit.

Tilt System Discussion

In accordance with the invention, the electronic bypass circuits also disable all of the lamps in response to a tilt condition occurring in any of the LHAs in the system. A tilt condition results (and a tilt signal is generated) when any of the LHAs in the system experiences a predetermined magnitude of change in its physical attitude. Tilt system operation is controlled by microcontroller 46. When a tilt condition exists, microcontroller 46 not only causes the disablement of all of the lamps in its associated LHA, but signals the occurrence of a tilt condition, via the control loop that is monitored by the other microcontrollers in the corresponding LHAs. These microcontrollers sense the tilt signal in the control loop and deactivate their corresponding lamps. The criteria for generating a tilt signal may be established by the airport operator or other controlling authority so that temporary disruptions of orientation due, for example to strong wind gusts or the like, do not result in disablement of the PAPI system. The inventive arrangement will also be seen to be automatic and when a tilt condition is removed, operation of the LHA system returns to normal.

A tilt switch 54 (an optical pendulum in the preferred embodiment) develops an indication whenever the physical attitude of the LHA has been compromised by a predetermined amount, i.e., to the extent that it no longer can be relied upon to accurately establish the correct vertical approach angle. While the optical pendulum tilt switch shown is preferred, the present invention may be used with any prior art tilt switches to good advantage. The local tilt drive 70 comprises an LED 71 that is energized through a resistor 72 from V2 to transmit a beam of light through a slot in the freely movable pendulum of tilt switch 54. Local tilt detector 58, which develops a tilt signal, includes a photo detector transistor 73 that receives the light beam from LED 71 as long as the physical attitude of the LHA is not disrupted beyond the tolerance of the slot in the pendulum of tilt switch 54. The collector of photo detector transistor 73 is connected to V2 through a resistor 57. The junction of resistor 57 and transistor 73 is coupled, through a resistor 59, to the gate of a buffer-inverter FET 55 that has its drain connected to V2 through a resistor 56 and to pin 3 of microcontroller 46.

With photo detector 73 conducting in response to the light beam from LED 71, the potential at the gate of FET 55 keeps it nonconductive. Should the LHA be physically moved, the slot in the pendulum of tilt switch 54 will no longer be in alignment with the light beam between LED 71 and photo detector 73 and the light beam will be interrupted. Therefore photo detector 73 ceases conduction, whereupon the gate voltage of FET 55 rises and drives FET 55 into conduction. This change, signifying the possible existence of a tilt condition, is sensed by microcontroller 46, which after a predetermined time interval selected to avoid spurious operation, verifies that a tilt condition does exist and generates a signal to simultaneously activate common lamp control 48 and remote tilt driver 90.

Remote tilt driver 90 comprises a transistor 91 having its emitter-collector circuit connected between V1 and the input of a voltage regulator 96, and its base coupled to the drain of an FET 92, the gate of which is coupled to pin 2 of microcontroller 46. The output of regulator 96 is connected to a protection diode 93 and is connected to the OUT terminal through a resistor 97. The OUT terminal is also connected through a resistor 81 to: the cathode of a diode 94, the anode of which is connected to ground; the anode of a diode 95, the cathode of which is connected to V2; and to the junction of pin 7 of microcontroller 46 and a capacitor 82, the other terminal of which is returned to ground. Diodes 94 and 95 act as protective diodes at pin 7 of microcontroller 46. The IN terminal is connected to ground. It should be noted that the ground points in each LHA are isolated and distinct from earth ground. The control loop circuit is formed by connecting the OUT terminal of LHA 12 to the IN terminal of LHA 14 and the OUT terminal of LHA 14 to the IN terminal of LHA 16 in a daisy chain configuration that ends with the OUT terminal of LHA 18 being connected to the IN terminal of LHA 12.

FET 49, in common lamp control 48, is driven from pin 6 of microcontroller 46 and controls operation of transistor 50, whose output is in series with opto-couplers 29, 31 and 33 in the bypass circuits. Normally microcontroller 46 places a logic 1 voltage on pin 6 which drives FET 49 into conduction causing conduction of transistor 50 and energization of the opto-couplers. When opto-coupler 29 is energized, the transistor 100 within opto-coupler 29 is conductive. Gate drive current to SCR 61, via resistor 99, is bypassed to the cathode of SCR 61 by conducting transistor 100. This keeps SCR 61 nonconductive, placing bypass circuit 12 in a non conductive state, allowing lamp 20 to be illuminated. Responsive to a tilt condition, microcontroller 46 places a logic 0 voltage on pin 6 which keeps FET 49 non conductive, causing non conduction of transistor 50 and deenergization of the opto-couplers. Opto-coupler 29 allows resistor 99 to trigger SCR 61 into conduction which places a low impedance path across corners "c" and "d" of diode bridge 62, simulating an avalanche condition in zener diode 63. This gives rise to a second-trigger voltage at the corners "a" and "b" of diode bridge 62 which drives SCRs 64 and 65 alternately conductive, as before. Thus the voltage across the terminals of lamp 20 is reduced (effectively extinguishing the lamp) as previously discussed. This action simultaneously occurs in each of the other bypass circuits 30 and 32. Here again, the lamps will remain extinguished as long as the tilt condition persists. It will be noted that when lamp 20 fails, the trigger voltage is determined by zener 63 and is about 47 volts. SCR 61 conducts at a much lower voltage.

The programming of microcontroller 46 includes a timing arrangement for assuring that a tilt condition exists for a predetermined time before developing a tilt signal. This reduces spurious operation due to transient disturbances of physical positioning, such as from strong wind gusts and the like. Under normal operating conditions, when the LHA is not in a tilt condition, transistor 91 and FET 92 are conducting. The voltage V1 is about 15 volts and the action of the voltage regulator 96 results in a voltage at the output of voltage regulator 96 of about 12 volts. With all of the OUT and IN terminals of all four isolated LHAs 12,14,16 and 18 connected in series, the sum of the voltage rise from voltage regulator 96 (and the corresponding regulators) and the voltage drop across resistor 97 (and the corresponding resistors) is zero. The resulting voltage at terminal OUT is zero volts. When a tilt signal is generated, due to a tilt condition existing for the requisite amount of time, the voltage at pin 2 of microcontroller 46 turns FET 92 and transistor 91 off which results in an output of 0 volts from voltage regulator 96. This represents a loss of 25% of the total voltage produced by all of the voltage regulators in the loop. The net effect is to reduce the voltage across resistor 97 and its counterparts in all of the LHAs by 25% (from 12 to 9 volts), resulting in a net voltage of 3 volts at terminal OUT of all of the LHAs. This voltage is recognized as a logic 1 (at pin 7, via resistor 81) of all of the microcontrollers in the array. The microcontrollers in the LHAs sense the logic 1 at pin 7 and provide a logic 0 at pin 6 which deenergizes all of the opto-couplers. This allows resistor 99 (and its corresponding elements in the other bypass circuits) to provide gate trigger current to SCR 61, causing all bypass circuits to conduct and effectively extinguishing all of the lamps in the array. It will be noted that if a two LHA array is used in the PAPI system, the total voltage from all of the regulators is reduced by 50%.

Remote tilt detector 80, consisting of a resistor 81 and a noise filter capacitor 82, is coupled to pin 7 of microcontroller 46 which senses a drop of about 25% (or 50% in the case of a two LHA array) in the voltage at the OUT and IN terminals as constituting a tilt signal. This voltage drop appears across all of the OUT and IN terminals of the LHAs and is sensed by the corresponding remote tilt detectors and microcontrollers in the other LHAs, which respond by disabling all of their lamps. Thus, a simple two-wire control loop among the LHAs in the array is used for monitoring and disabling all of the LHAs in response to a tilt signal generated by any of the LHAs in the array.

Each LHA also includes a tilt indicator 85 for providing a visual indication of a tilt condition. In accordance with this aspect of the invention, a red LED 86 is illuminated when the physical attitude of the LHA is disrupted to cause a tilt condition and a green LED 87 is illuminated when the LHA is in vertical alignment. The housing of prior art pendulum type tilt switch is affixed to a properly aimed LHA and aligned with a spirit level. After the housing is leveled, the LHA is tested to verify that the tilt switch is properly installed. Not only is this procedure time-consuming, the use of a spirit level adds a variable degree of installer skill which results in an undesirable range of tilt switch tolerances. With the invention, the tilt switch housing may be easily and accurately installed on the LHA by the installer simply observing an LED. When the green LED is illuminated, the switch is properly installed. In the preferred embodiment of this invention the tilt switch pendulum has a very narrow, laser formed slot, which assures close tolerances on the tilt switch.

The local tilt indicator 85, as mentioned above, is coupled to pin 5 of microcontroller 46. Pin 5 of the microcontroller is connected to the junction of green LED 86 and red LED 87. Assuming the LEDs to illuminate at 5 volts, it will be seen that when pin 5 is at logic 1, green LED 86 is on (illuminated) and red LED 87 is off. For a logic 0 at pin 5, green LED 86 is off and red LED 87 is on. Thus the interruption of the light beam in tilt switch 54 translates into an illuminated red LED 87, whereas an uninterrupted light beam, corresponding to a correct positioning of the LHA, translates into an illuminated green LED 86.

What has been described is a novel PAPI Style B system of improved cost and efficiency and that is more readily and accurately installed and maintained. It is recognized that numerous changes in the described embodiment of the invention will occur to those skilled in the art, without the need for inventive skill. Therefore, the scope of the invention is to be limited only as defined in the claims.

The invention claimed is:

1. A PAPI 1 Style B lighting system comprising:

a lamp housing assembly;

a plurality of lamps in said lamp housing assembly connected in an AC constant current series circuit;

a corresponding plurality of electronic bypass circuits coupled across said lamps, a first voltage resulting from a failure of a lamp activating its associated electronic bypass circuit to maintain the integrity of said constant current series circuit;

a microcontroller coupled to said plurality of electronic bypass circuits;

a tilt switch monitoring the physical attitude of said lamp housing assembly; and said microcontroller activating all of said electronic bypass circuits to disable said plurality of lamps, responsive to activation of said tilt switch.

2. The system of claim 1, wherein each of said electronic bypass circuits comprises:

first and second oppositely poled SCRs coupled across a corresponding one of said lamps;

said first voltage activating corresponding ones of said first and second SCRs and initiating alternate conduction therein; and further including:

a lamp control circuit in each said bypass circuit; and said lamp control circuit establishing a second voltage for initiating alternating conduction in said first and second SCRs in all of said bypass circuits under control of said microcontroller.

3. The system of claim 2, wherein each of said bypass circuits further includes:

a zener diode; and a diode bridge coupled between said zener diode and said first and second SCRs.

4. The system of claim 3, wherein each of said lamp control circuits further includes a third SCR coupled across said zener diode for establishing said second voltage.

5. The system of claim 4, wherein each of said lamp control circuits includes a photo-optic coupler connected to the gate of its corresponding third SCR and wherein said photo-optic coupler is activated responsive to operation of said tilt switch.

6. The system of claim 5 further including a common lamp control circuit coupled between said microcontroller and said photo-optic couplers in each said bypass circuit.

7. The system of claim 1, wherein said tilt switch comprises:

an LED affixed to said lamp housing assembly and generating a light beam;

a photo detector affixed to said lamp housing assembly in alignment with said LED;

a pendulum pivotally mounted to said lamp housing assembly and interposed between said LED and said photo detector;

said pendulum having a slot whereby said photo detector receives said light beam when said physical attitude of said lamp housing assembly is undisturbed; and an indicator responsive to said pendulum interrupting said light beam.

8. The system of claim 7, wherein a lamp control circuit is included in each of said bypass circuits and wherein said microcontroller activates said lamp control circuit responsive to interruption of said light beam for a predetermined time period.

9. The system of claim 8, wherein said indicator comprises a pair of different colored LEDs, said microcontroller causing selective activation of said LEDs responsive to said pendulum.

10. The system of claim 1, further including:

a plurality of substantially identical lamp housing assemblies interconnected by a series connected control loop;

a remotely located constant current source;

a corresponding plurality of below-ground handholes each including an isolation transformer for supplying a respective one of said lamp housing assemblies and having four above-ground external power terminals and four above-ground external control terminals;

each of said lamp housing assemblies having two external power terminals connected to said constant current source via its associated handhole and two external control terminals coupled, via its associated handhole, in said control loop;

each said microcontroller monitoring said control loop and activating all of said electronic bypass circuits via said control loop for disabling all of said plurality of lamps in said array, responsive to activation of any of said tilt switches; and two power wires interconnecting said lamp housing assemblies, said handholes and said constant current source and two control wires interconnecting said lamp housing assemblies and said handholes.

11. A PAPI 1 Style B lighting system comprising:

a plurality of identical lamp housing assemblies, each including:

a plurality of lamps connected in an AC constant current series circuit;

a corresponding plurality of electronic bypass circuits coupled across said lamps, a first voltage resulting from a failure of a lamp activating its associated electronic bypass circuit to maintain the integrity of said constant current series circuit;

a microcontroller coupled to said plurality of electronic bypass circuits;

a tilt switch monitoring the physical attitude of said lamp housing assembly; and said microcontroller activating all of said electronic bypass circuits to disable said plurality of lamps, responsive to activation of said tilt switch;

a control loop interconnecting said lamp housing assemblies;

each said microcontroller applying a tilt status indication, corresponding to the tilt status of its associated tilt switch, to said control loop; and each said microcontroller monitoring said control loop and activating its associated lamp control circuit responsive to a tilt status indication in said control loop.

12. The system of claim 11, wherein each of said electronic bypass circuits in each of said lamp housing assemblies comprises:

first and second oppositely poled SCRs coupled across a corresponding one of said lamps;

said first voltage activating corresponding ones of said first and second SCRs and initiating alternate conduction therein; and further including:

a lamp control circuit in each said bypass circuit; and said lamp control circuit establishing a second voltage for initiating alternating conduction in said first and second SCRs in all of said bypass circuits under control of said microcontroller.

13. The system of claim 12, wherein each said bypass circuit further includes:

a zener diode; and a diode bridge coupled between said zener diode and said first and second SCRs.

14. The system of claim 13, wherein each of said lamp control circuits further includes a third SCR coupled across said zener diode for establishing said second voltage.

15. The system of claim 14, wherein each of said lamp control circuits includes a photo-optic coupler connected to the gate of its corresponding third SCR and wherein said photo-optic coupler is activated responsive to operation of said tilt switch.

16. The system of claim 15 further including a common lamp control circuit coupled between said microcontroller and said photo-optic couplers in each said bypass circuit.

17. The system of claim 11, wherein each of said tilt switches comprises:

an LED affixed to its associated lamp housing assembly and generating a light beam;

a photo detector affixed to its associated lamp housing assembly in alignment with said LED;

a pendulum pivotally mounted to its associated lamp housing assembly and interposed between said LED and said photo detector;

said pendulum having a slot whereby said photo detector receives said light beam when said physical attitude of said associated lamp housing assembly is undisturbed; and an indicator responsive to said pendulum interrupting said light beam.

18. The system of claim 17, wherein a lamp control circuit is included in each of said bypass circuits and further including:

each said microcontroller activating its associated lamp control circuit responsive to interruption of said light beam in its associated lamp housing assembly for a predetermined time period.

19. The system of claim 18, wherein said indicator comprises a pair of different colored LEDs, said microcontroller causing selective activation of said LEDs responsive to said pendulum.

20. A PAPI 1 Style B lighting system comprising:

a lamp housing assembly;

a plurality of lamps in said lamp housing assembly connected in an AC constant current series circuit;

a corresponding plurality of electronic bypass circuits coupled across said lamps;

a microcontroller coupled to said plurality of electronic bypass circuits;

each of said electronic bypass circuits including:

first and second oppositely poled SCRs, coupled across a corresponding one of said lamps, a zener diode, and a diode bridge coupled between said zener diode and said first and second SCRs;

a first voltage, resulting from a failure of a lamp, activating corresponding ones of said first and second oppositely poled SCRs and initiating alternate conduction therein to maintain the integrity of said constant current series circuit;

a tilt switch for monitoring the physical attitude of said lamp housing assembly;

a lamp control circuit in each said electronic bypass circuit;

said microcontroller activating all of said lamp control circuits to disable said plurality of lamps, responsive to said tilt switch;

each of said lamp control circuits further including:

a third SCR coupled across said zener diode for establishing a second voltage for initiating alternating conduction in said first and second SCRs in all of said bypass circuits; and a photo-optic coupler controlling its corresponding third SCR.

21. The system of claim 20, wherein said tilt switch comprises:

an LED affixed to said lamp housing assembly and generating a light beam;

a photo detector affixed to said lamp housing assembly in alignment with said LED;

a pendulum pivotally mounted to said lamp housing assembly and interposed between said LED and said photo detector;

said pendulum having a slot whereby said photo detector receives said light beam when said physical attitude of said lamp housing assembly is undisturbed; and an indicator responsive to said pendulum interrupting said light beam.

22. The system of claim 21, wherein said indicator comprises a pair of different colored LEDs, said microcontroller causing selective activation of said LEDs responsive to said pendulum.

* * * * *